US012781737B2

(12) United States Patent
Bendixen et al.

(10) Patent No.: US 12,781,737 B2
(45) Date of Patent: Nov. 3, 2026

(54) ADJUSTABLE PUMP FOR PUMPING A LIQUID FOOD PRODUCT

(71) Applicant: Tetra Laval Holdings & Finance S.A., Pully (CH)

(72) Inventors: Ole Bendixen, Højbjerg (DK); Michel Noaparast, Højbjerg (DK)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 19/109,174

(22) PCT Filed: Nov. 27, 2023

(86) PCT No.: PCT/EP2023/083127

§ 371 (c)(1),
(2) Date: Mar. 6, 2025

(87) PCT Pub. No.: WO2024/115366

PCT Pub. Date: Jun. 6, 2024

(65) Prior Publication Data

US 2026/0078755 A1 Mar. 19, 2026

(30) Foreign Application Priority Data

Nov. 29, 2022 (EP) ..... 22210401

(51) Int. Cl.
*F04C 14/18* (2006.01)
*F04C 2/10* (2006.01)

(52) U.S. Cl.
CPC ..... *F04C 14/185* (2013.01); *F04C 2/102* (2013.01); *F04C 2270/16* (2013.01)

(58) Field of Classification Search
CPC ..... F04C 14/185; F04C 2/102; F04C 2270/16
See application file for complete search history.

(56) References Cited

U.S. PATENT DOCUMENTS 1,672,257 A 6/1928 Heitz
3,876,349 A * 4/1975 Svensson ..... F04C 2/101 418/181

(Continued)

FOREIGN PATENT DOCUMENTS

DE 481682 C 9/1929

OTHER PUBLICATIONS

Extended European Search Report dated Aug. 24, 2023, for European Application No. 2210401.0.

(Continued)

*Primary Examiner* — Jesse S Bogue
(74) *Attorney, Agent, or Firm* — Renner, Otto, Boisselle & Sklar

(57) ABSTRACT

A pump for pumping a liquid food product, the pump comprising a housing, an impeller arranged to rotate inside the housing, a star wheel arranged to be driven by the impeller, and a base unit to which the star wheel is connected, the base unit being movable in a longitudinal direction, from a closed position, to an open position. An adjustment device is configured to adjustably set a position of the base unit in the longitudinal direction to thereby, when the base unit is in the closed position, provide in the longitudinal direction a predetermined adjusted distance between the impeller and the star wheel and/or between the impeller and the base unit.

13 Claims, 7 Drawing Sheets

(56) References Cited

U.S. PATENT DOCUMENTS

Figure 1:
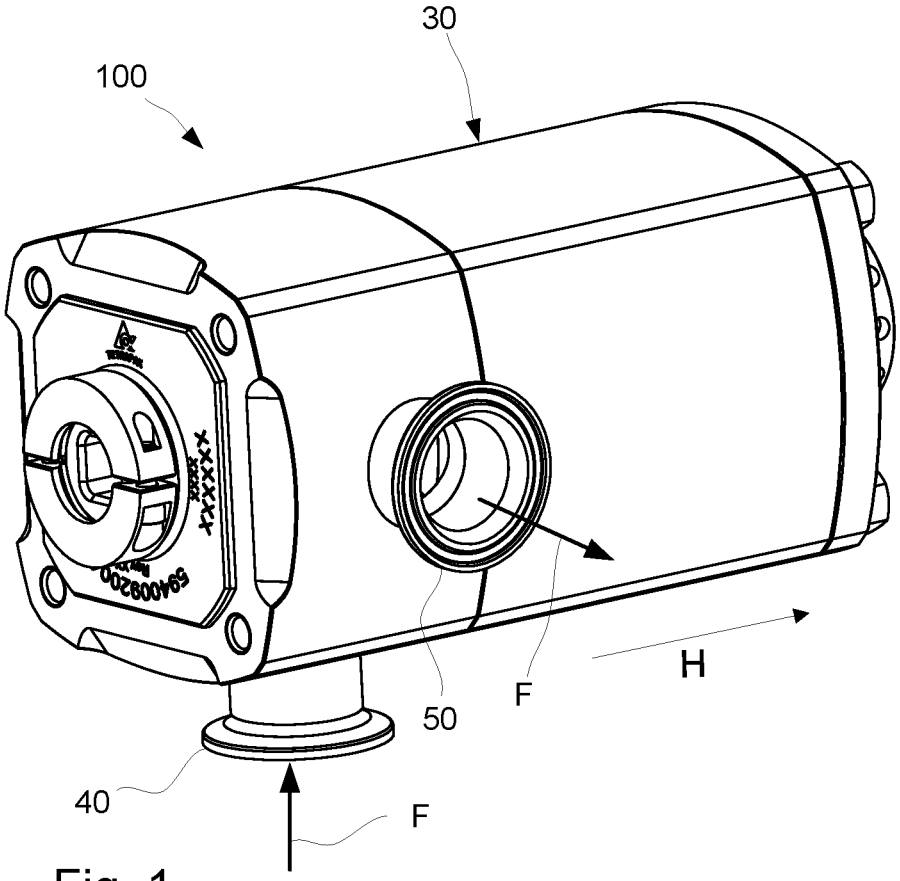

| | | | | |
|---|---|---|---|---|
| 5,489,187 | A * | 2/1996 | Ray | F04D 29/2266 415/111 |
| 8,474,339 | B2 * | 7/2013 | Hirai | B64C 25/24 74/89.23 |
| 10,876,528 | B2 * | 12/2020 | Bendixen | F04C 2/08 |
| 11,326,597 | B2 * | 5/2022 | Bendixen | F04C 2/101 |

OTHER PUBLICATIONS

International Search Report mailed Apr. 4, 2024, for International Application No. PCT/EP2023/083127.

* cited by examiner

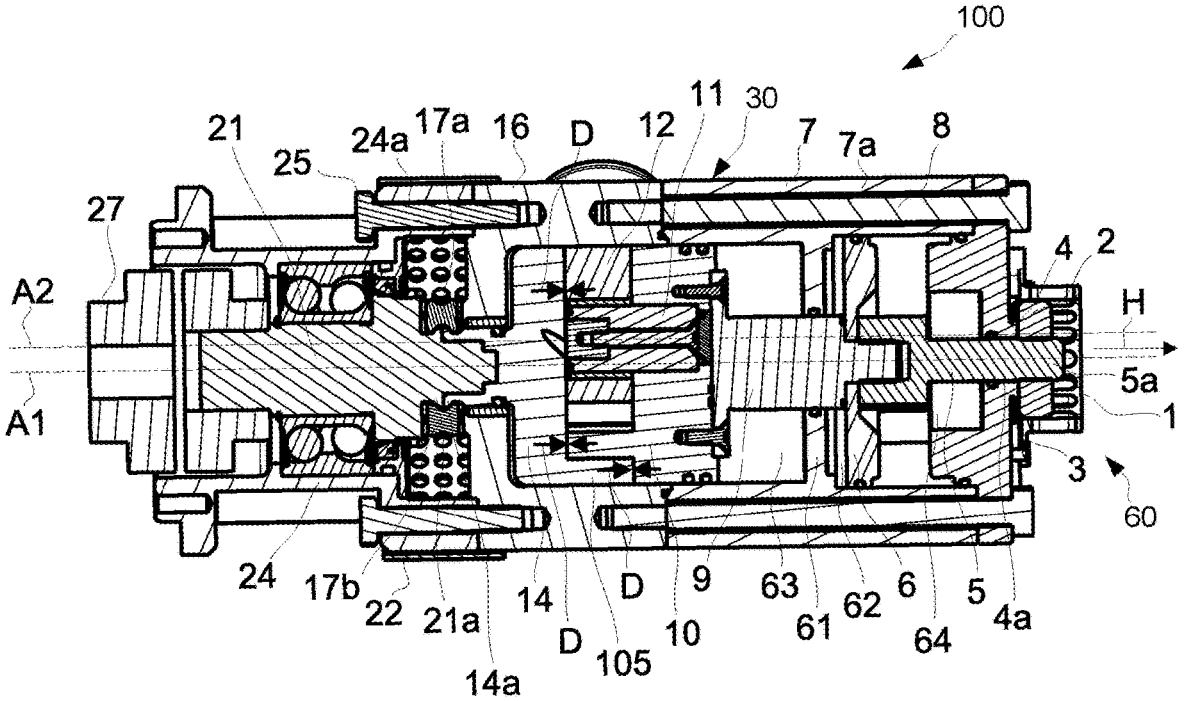
Fig. 6 (P1)
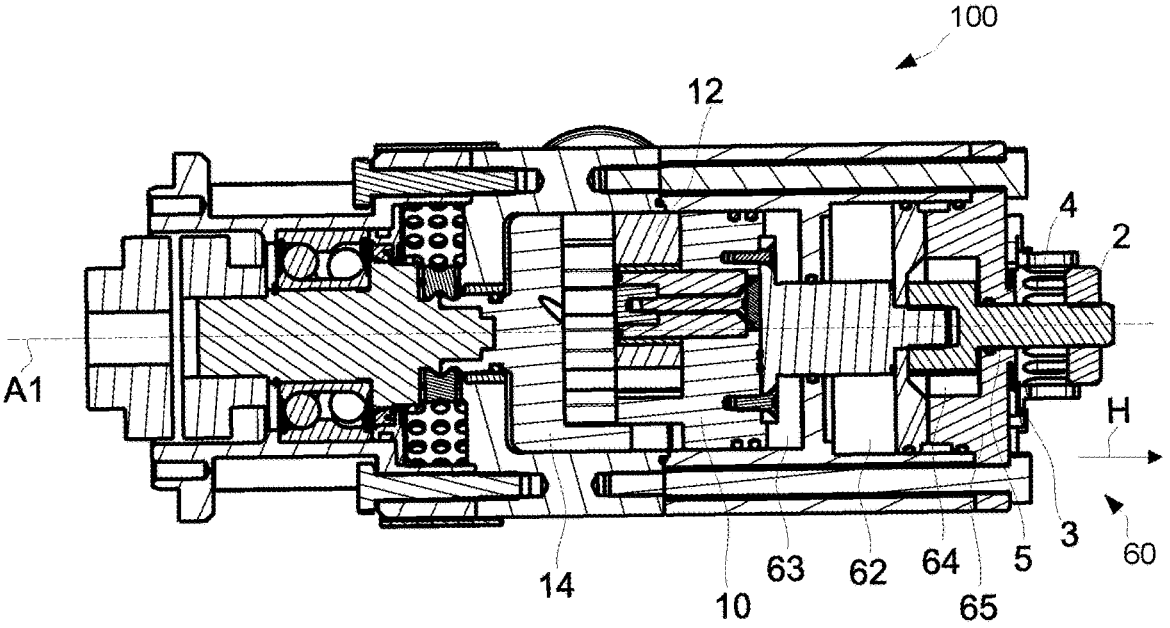
Fig. 7 (P2)

ADJUSTABLE PUMP FOR PUMPING A LIQUID FOOD PRODUCT

TECHNICAL FIELD

The invention relates to a pump for pumping a liquid food product and a method of adjusting a pump.

BACKGROUND ART

Today a number of food handling apparatuses are used in the food processing industry, such as pumps that are used for transporting the food through a food processing line. One type of food processing lines is used to produce ice cream products, which includes dairy based ice cream products as well as water-based frozen snack (ice pops). Frozen custard, frozen yogurt, sorbet, gelato and frozen dairy dessert are some product names that are used to distinguish different varieties and styles of ice cream products.

During large scale production of an ice cream product, the product is often pumped through pipes and different types of equipment that are part of the food processing line. This applies for both the finished ice cream product as well as for ice cream products (ingredients and mixtures) that eventually will form the finished ice cream product. Special pumps are often used for pumping ice cream products in form of either finished products or ingredients/mixtures that will form part of the finished product. These pumps have moving parts and, as with most pumps, there is some wear between the moving parts. The parts subjected to wear are made of safe materials that are naturally present in the human body and the wear is so small that the product does not become contaminated. However, the worn pump parts must eventually be replaced, which introduces costs and production down-time. In addition, during replacement of the worn pump parts, customers may occasionally destroy expensive parts or may imperfectly adjust the pump parts which introduces more costs and a poor performance of the pump. Furthermore, the pumps need to be cleaned on a regular basis using a clean-in-place (CIP) process and may need to be adjusted subsequent to the CIP process.

Although present pumps generally work well, there is room for improving pumps, in particular in view of the abovementioned challenges and limitations.

SUMMARY

It is an object of the invention to at least partly overcome one or more of the above-identified limitations of the conventional pumps. In particular, it is an object to provide a pump that has reduced wear and less production down-time and a hence longer life time, compared to the conventional pumps. It is another object of the invention to provide a pump that may be adjusted, opened and/or closed in a more user-friendly manner, compared to the conventional pumps.

According to a first aspect of the invention, a pump for pumping a liquid food product is provided. The pump comprises a housing having an inlet and an outlet for the product, an impeller arranged to rotate inside the housing around a first axis of the pump, a star wheel arranged to be driven by the impeller to rotate around a second axis of the pump that is offset from the first axis, and a base unit arranged to support the star wheel. The base unit is movable in a longitudinal direction parallel to the first axis, from a closed position, to an open position. The base unit comprises an arc-shaped element that extends in between the star wheel and the impeller, such that the product is pumped from the inlet to the outlet when the base unit is in the closed position and the impeller rotates and drives the star wheel. The pump has an adjustment device that is configured to adjustably set a position of the base unit in the longitudinal direction to thereby, when the base unit is in the closed position, provide in the longitudinal direction a predefined adjusted distance between the impeller and the star wheel and/or between the impeller and the base unit.

The pump is advantageous in that the position of the base unit relative the impeller can be conveniently set such that the longitudinal distance between the impeller and the star wheel and/or between the impeller and the base unit is very small. A small distance enables high pumping efficiency while wear between the parts is reduced. This increases operational lifetime, as compared to a conventional pump of similar type where the parts are, as seen in the longitudinal direction, in contact with each other. Herein, predefined adjusted distance means that the distance is set to a desired value (predefined) that can be adjusted by means of the adjustment device.

As used herein, the "closed position" refers to a position where the star wheel is positioned further, or deeper, into the impeller, as compared to the "open position" where the star wheel is located further out, or less deep within, the impeller. The "closed position" may be understood a first position of the star wheel relative the impeller, and the "open position" may be understood a second position of the star wheel relative the impeller, where the first position is different from the second position.

The adjusted distance may be at most 2.0 mm, at most 1.0 mm, at most 0.5 mm or at most 0.2 mm, between the impeller and the star wheel and/or between the impeller and the base unit, as seen in the longitudinal direction. This allows for a fixed gap and which results in a significant wear reduction, compared to the conventional pumps. The wear reduction allows for a longer life time and less production down-time.

The adjustment device may comprise a rod connected to the base unit and having an outer part that extends through an opening in the housing. The adjustment device may comprise a stationary element that has a fix position relative the housing. The adjustment device may comprise an adjustable element in engagement with the outer part of the rod and arranged to interact with the stationary element for providing the adjusted distance.

As used herein "outer part" refers a part of the rod that is located externally of the housing, and/or extends out from the housing. In contrast, the impeller, the star wheel and the base unit are arranged internally in the housing. Thus, "outer part" may refer to a part of the rod that is located outside a structure or body (housing) that encloses the impeller, the star wheel and the base unit. The "outer part" of the rod is still a part of the rod.

The adjustment device prevents the rod, and thus the base unit, from moving further into the pump in direction towards the impeller. This is accomplished by the adjustment device coming into contact with the stationary element when the base unit is moved from the closed position to the open position.

Thereby, the adjustable element, in engagement with the outer part of the rod and in interaction with the stationary element, may allow for adjustably setting the position of the base unit for providing the adjusted distance. The rod, the stationary element and the adjustable element may be arranged at one side on the pump.

The adjustable element may be movable in the longitudinal direction relative to the stationary element and/or relative to the rod for providing the adjusted distance.

Thereby, by setting the position of the adjustable element in the longitudinal direction, relative to the stationary element and/or the rod, the position of the base unit in the longitudinal direction may be set.

The adjustable element may be movable, in sequential order and in the longitudinal direction, to a first position out of contact with the stationary element, when the impeller and the star wheel and/or the impeller and the base unit are in contact with each other, a second position in contact with the stationary element, and a third position that is offset from the second position by a distance corresponding to the adjusted distance, as seen in the longitudinal direction relative the stationary element and/or the rod.

Thereby, the adjustment mechanism may be performed in an efficient manner e.g. in a more controlled and precise manner.

The first position of the adjustable element may represent a position where the adjustable element is out of contact with the stationary element, while simultaneously the impeller and the star wheel and/or the impeller and the base unit are in contact with each other.

The second position of the adjustable element may represent a position where the adjustable element is in contact with the stationary element, while simultaneously the impeller and the star wheel and/or the impeller and the base unit are in contact with each other.

The third position of the adjustment element may represent a position where the adjustable element is in contact with the stationary element, while simultaneously the impeller and the star wheel and/or the impeller and the base unit are out of contact with each other. As used herein, the impeller and the star wheel and/or the impeller and the base unit now being "out of contact" means that there is a small distance between the impeller and the star wheel and/or the impeller and the base unit. The third position is the adjusted position, which represents the position the adjustment element shall have when the pump is operated, as it effectively reduces wear of the pump.

The first position, the second position and the third position may be a sequential order of an adjustment mechanism. The adjustable element may be a nut. For instance, a technician may first move the adjustable element e.g. unscrew the nut such that it becomes out of contact with the stationary element. The technician may next arrange the impeller, the star wheel and the base unit such that the impeller and the star wheel and/or the impeller and the base unit are in contact with each other i.e. the first position. This may e.g. be performed by pushing the rod which is connected to the base unit all the way in, in a direction along the longitudinal direction, towards the impeller. The technician may next move the adjustable element e.g. screw the nut such that it becomes in contact with the stationary element i.e. the second position. The technician may next adjust the adjustable element such that it becomes offset from the second position by a distance corresponding to the adjusted distance, as seen in the longitudinal direction relative the stationary element and/or the rod i.e. the third position. The technician may e.g. slightly tighten the nut such that the position of the nut relative the stationary element and/or the rod corresponds to the adjusted distance, e.g. by tighten the nut such that it "pulls out" the rod and thereby creates the adjusted distance.

The adjustable element may be movable, in sequential order and in the longitudinal direction (H), to a first position out of contact with the rod, when the impeller and the star wheel and/or the impeller and the base unit are in contact with each other, a second position in contact with the rod, and a third position that is offset from the second position by a distance corresponding to the adjusted distance, as seen in the longitudinal direction relative the stationary element and/or the rod.

Thereby, the adjustment mechanism may be performed in an improved manner e.g. in a more controlled and precise manner.

The first position, the second position and the third position may be a sequential order of an adjustment mechanism. The adjustable element may be a disk. For instance, a technician may first move the adjustable element e.g. unscrew the disk such that it becomes out of contact with the rod. The technician may next arrange the impeller, the star wheel and the base unit such that the impeller and the star wheel and/or the impeller and the base unit are in contact with each other i.e. the first position. This may e.g. be performed by pushing the rod which is connected to the base unit all the way in, in a direction along the longitudinal direction. The technician may next move the adjustable element e.g. screw the disk such that it becomes in contact with the rod i.e. the second position. The technician may next adjust the adjustable element such that it "pulls out" the rod by a distance corresponding to the adjusted distance, as seen in the longitudinal direction, to the third position.

The stationary element may be a part of the housing.

Thereby, the stationary element may have a fix position relative to the housing. The housing may have a plurality of parts. The stationary element may be a part of the housing corresponding to or connected/attached to an end section of the housing. This may in turn allow for an improved open/close and an improved adjustment mechanism in terms of accessibility and user-friendliness.

The adjustable element may be a threaded nut and the outer part of the rod may be provided with threads for engagement with the nut.

Thereby, the threaded nut may be conveniently screwed or unscrewed with respect to the outer threaded part of the rod, in the longitudinal direction. This in turn may allow for adjustably setting the position of the base unit, in the longitudinal direction, in a simple, user-friendly, and controlled manner.

The adjustment device comprises a nut locking element for fixing the nut on the outer part of the rod.

The nut locking element may ensure that the adjusted distance remains the same during operation of the pump. The locking element may be a further nut, a clamp, a sleeve or any other element that can mechanically fix the nut.

The adjustment device may comprise a motor arranged to set and fix the adjustable element in relation to at least one of the stationary element and the rod.

Thereby, the adjustable element may be set and fixed in relation to the at least one of the stationary element and the rod in a controlled and automated manner by the motor. The motor may comprise a torque sensor configured to sense a torque when setting the adjustable element to provide the adjustment distance.

The adjustment device may comprise a spacer that is located between the stationary element and the adjustable element for providing the adjusted distance.

Thereby, the spacer may further facilitate providing the adjusted distance between the impeller and the star wheel and/or between the impeller and the base unit. The spacer may have any shape, suitable for being located between the stationary element and the adjustable element.

The housing may comprise a protrusion around which the spacer is at least partially arranged, wherein the spacer extends, as seen in the longitudinal direction and in relation to the protrusion, further towards the adjustable element by a distance that corresponds to the adjusted distance.

Thereby, the protrusion may further facilitate providing the adjusted distance, in particular when the adjusted distance is very small.

The housing may comprise a first end section in which a shaft for the impeller is arranged, a mid-section in which the impeller is arranged, and a second end section in which at least one piston for moving the base unit is arranged. The first end section of the housing may have elongated through holes that extend in the longitudinal direction for receiving first bolts that connect the first end section to the mid-section, and the second end section of the housing may have elongated through holes that extend in the longitudinal direction for receiving second bolts that connect the second end section to the mid-section.

By virtue of the longitudinally extending through holes, the housing becomes rigid in the longitudinal direction. This effectively contributes to ensuring that the position set for the base unit in the longitudinal direction remains stable during operation of the pump.

The shaft for the impeller may comprise an annular protrusion that abuts a corresponding annular protrusion on the impeller. The pump may further comprise a clamp arrangement that comprises two semi-annular pieces. The two semi-annular parts may be configured to connected to each other around the protrusions for fixing the shaft to the impeller in the longitudinal direction.

Thereby, the clamp arrangement may allow for fixing the impeller such that the clamp arrangement may prevent or at least mitigate the impeller from moving back and forth in the longitudinal direction. This contributes to ensuring that the position set for the base unit in the longitudinal direction remains stable during operation of the pump.

According to a second aspect of the invention, a method of adjusting a pump is provided. The method comprises in the longitudinal direction, moving the adjustable element to a first position out of contact with the stationary element, when the impeller and the star wheel and/or the impeller and the base unit are in contact with each other. The method further comprises moving the adjustable element to a second position in contact with the stationary element. The method further comprises moving the adjustable element to a third position that is offset from the second position by a distance corresponding to the adjusted distance, as seen in the longitudinal direction relative the stationary element and/or the rod.

The pump may correspond to the pump defined above, in relation to the first aspect of the invention. The second aspect may generally present the same or corresponding advantages as the first aspect.

The method may further comprise, after the moving of the adjustable element to the second position and before the moving of the adjustable element to the third position, locating a spacer between the stationary element and the adjustable element for providing the adjusted distance.

Still other objectives, features, aspects and advantages of the invention will appear from the following detailed description as well as from the drawings.

DRAWINGS

Figure 2:
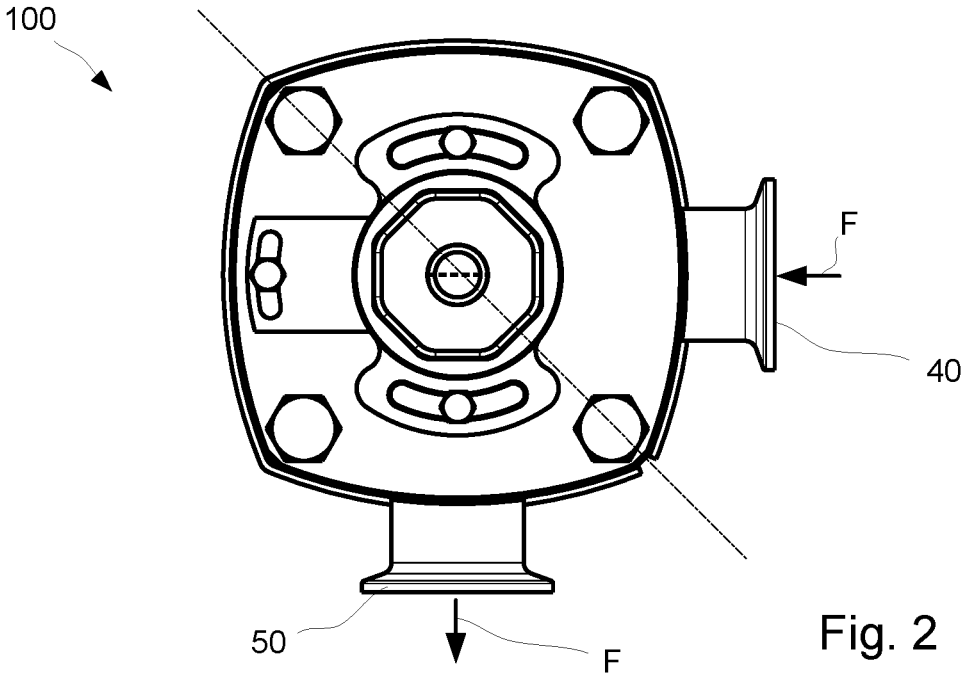
Figure 3:
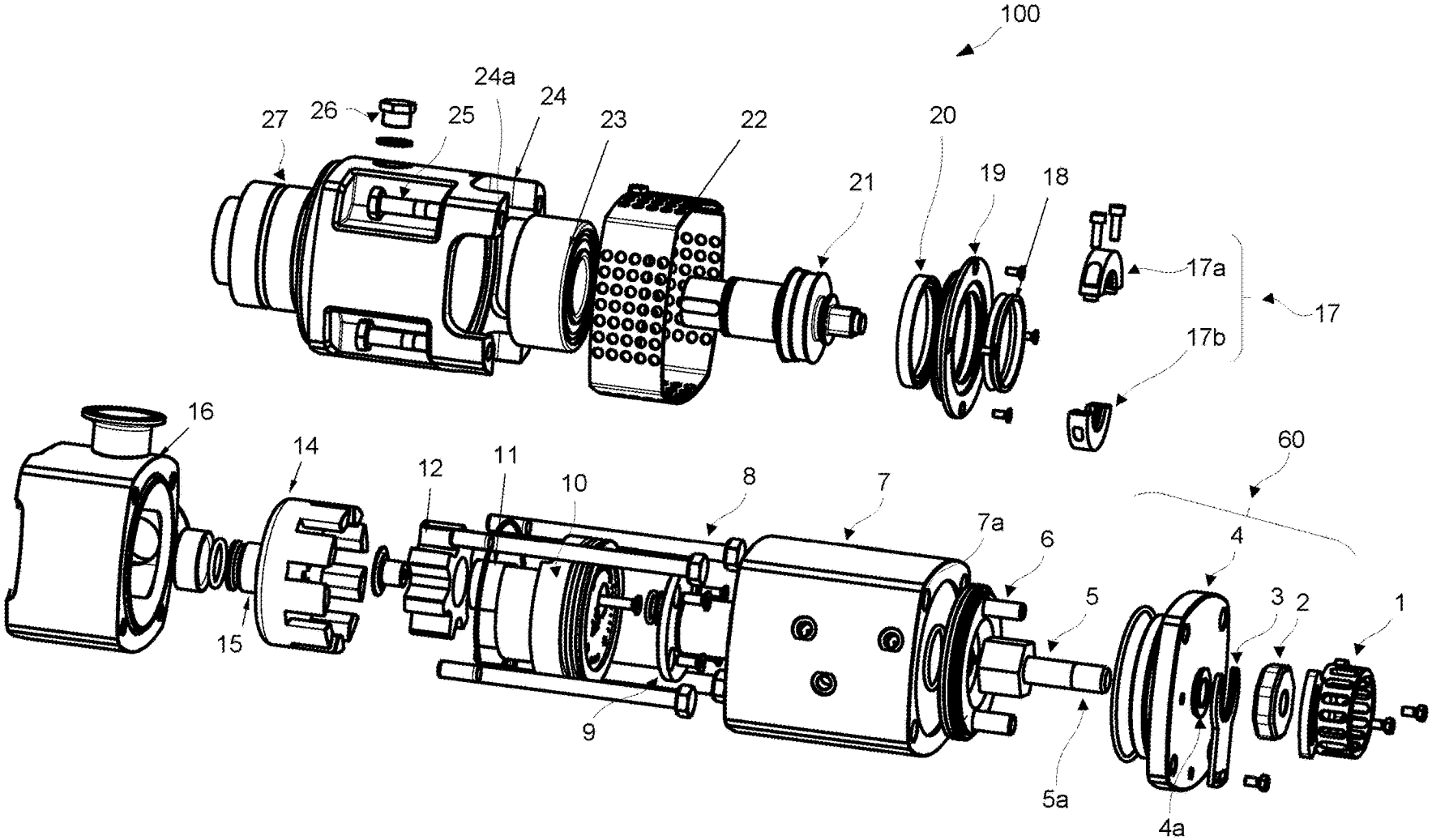
Figure 4:
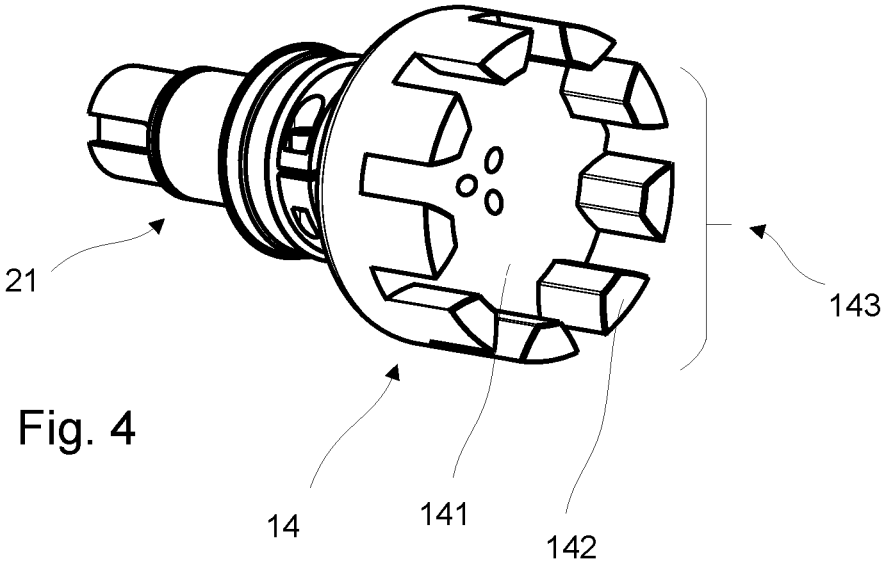
Figure 5A:
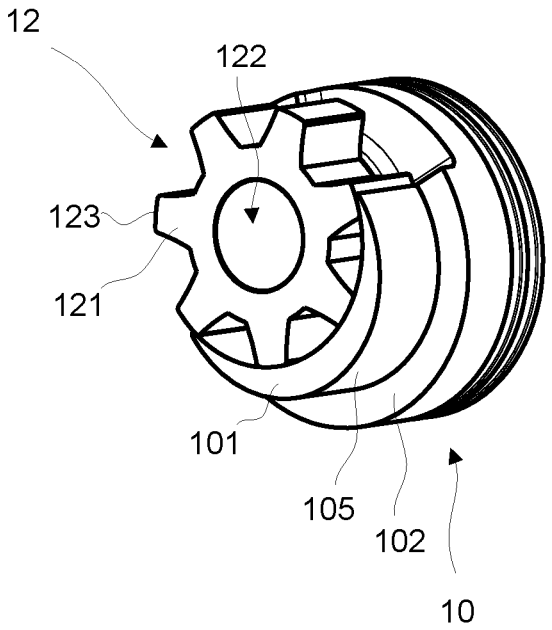
Figure 5B:
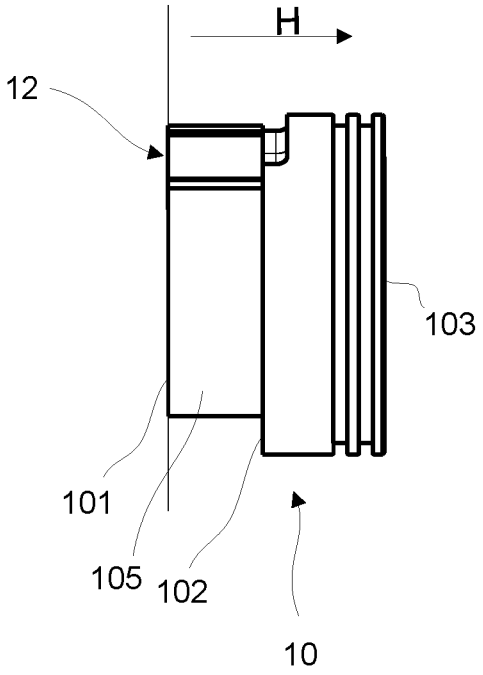
Figure 8:
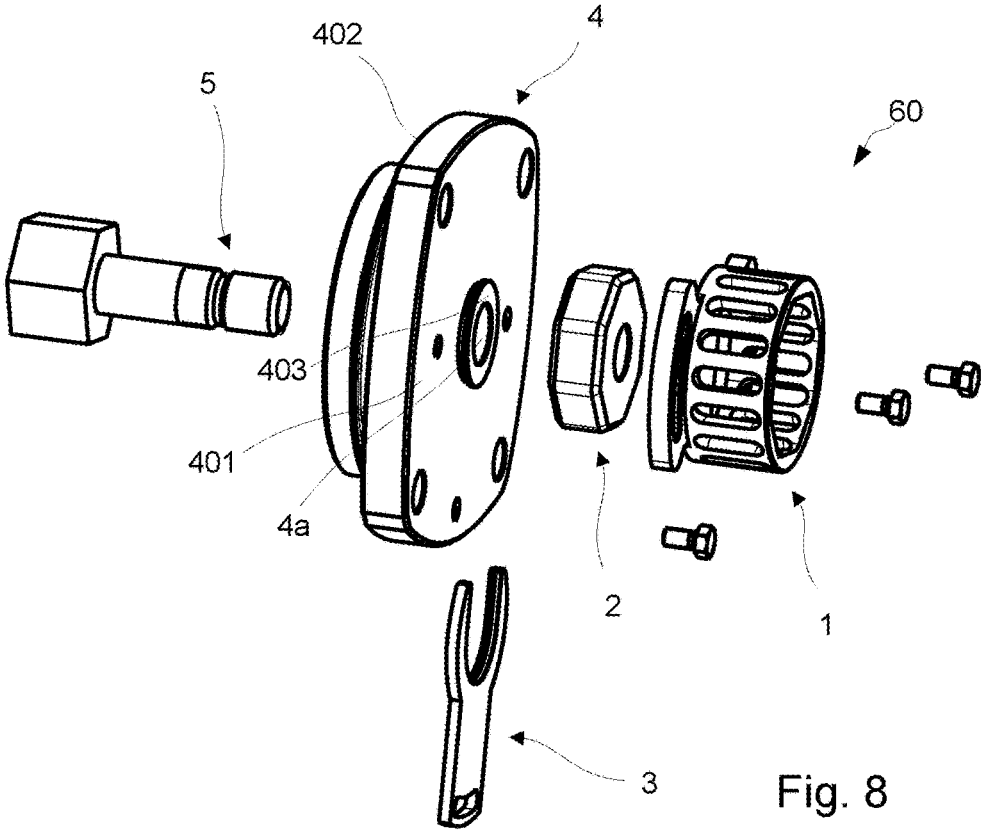
Figure 9:
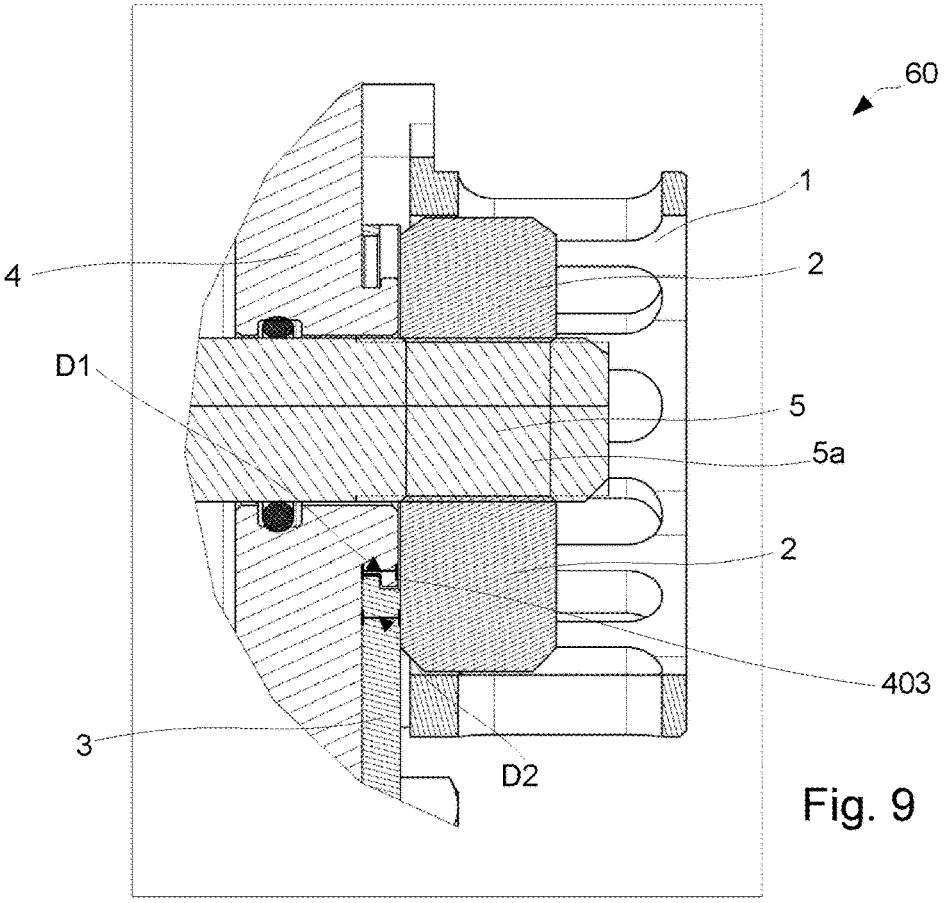
Figure 10A:
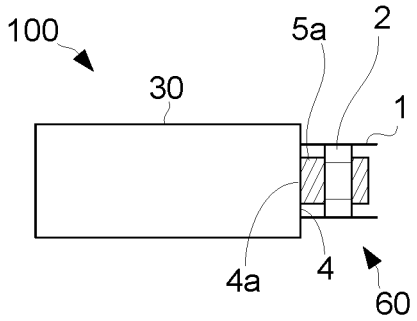
Figure 10B:
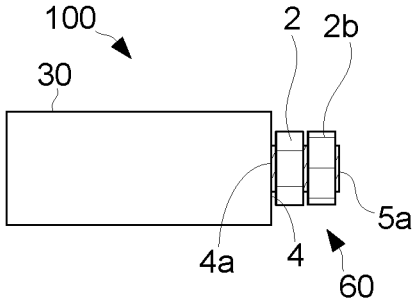
Figure 10C:
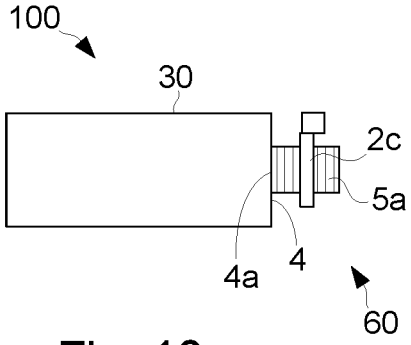
Figure 10D:
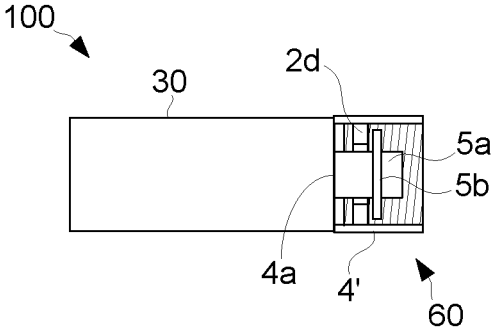
Figure 10E:
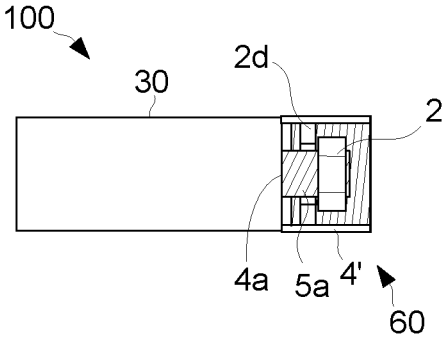
Figure 10F:
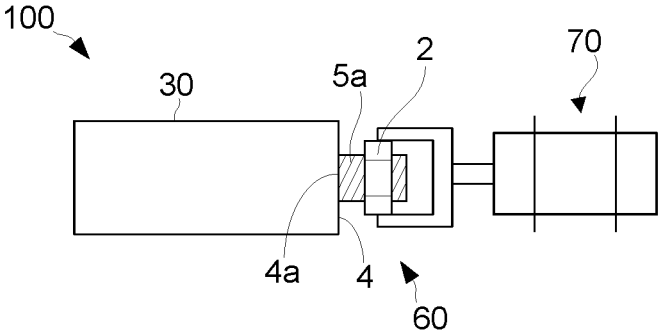
Figure 11:
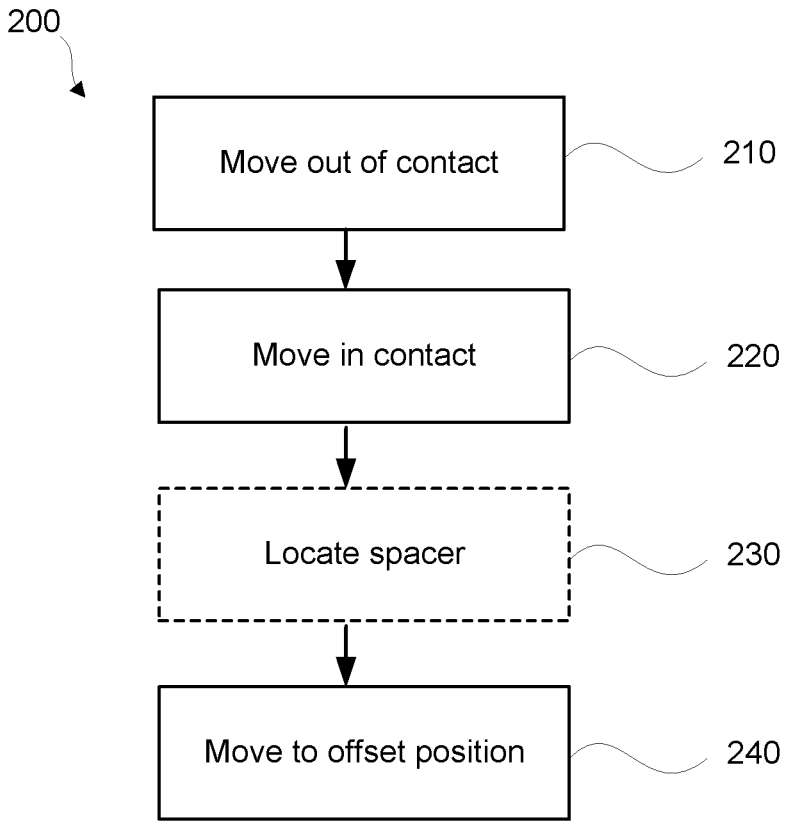

Embodiments of the invention will now be described, by way of example, with reference to the accompanying schematic drawings, in which FIG. 1 is a perspective view of a pump for pumping a liquid food product, FIG. 2 is a front view of the pump of FIG. 1, FIG. 3 is an exploded view of the pump of FIG. 1, FIG. 4 is a perspective view of an impeller and an impeller shaft of the pump of FIG. 1, FIG. 5*a* is a perspective view of a star wheel and a base unit of the pump of FIG. 1, FIG. 5*b* is a side view of the star wheel and the base unit FIG. 5*a*, FIG. 6 is a cross sectional side view of the pump of FIG. 1 in a closed position, FIG. 7 is a cross sectional side view of the pump of FIG. 1 in an open position, FIG. 8 is an exploded view of a part of the pump of FIG. 1, showing an adjustment device in perspective, FIG. 9 is a cross sectional, partial side view of the adjustment device of FIG. 8, FIG. 10*a-f* are side views of various embodiments of an adjustment device of a pump for pumping a liquid food product, and FIG. 11 is a flow chart of a method for adjusting a pump for pumping a liquid food product.

DESCRIPTION

FIGS. 1 and 2 shows a perspective view of a pump 100 for pumping a liquid food product F. A liquid food product is food that is capable of being pumped, and is consumable by humans to provide nutritional support. The liquid food product is a product that has either its final form, or is a food product in form of a mixture or an ingredient that can be pumped and which is intended to form part of a final food product. The liquid food product may be an ice cream product.

FIG. 1 shows that the pump 100 has a housing 30 that extends in a longitudinal direction H. With further reference to FIGS. 3, 6 and 7, a first end section 24 of the housing 30 may have elongated through holes 24*a* that extend in the longitudinal direction H for receiving first bolts 25 that connect the first end section 24 to a mid-section 16 of the housing 30. A second end section 7 of the housing 30 may have elongated through holes 7*a* that extend in the longitudinal direction H for receiving second bolts 8 that connect the second end section 7 to the mid-section 16. The pump 100 has an inlet 40 and an outlet 50 for the product F.

With reference to FIGS. 3, 4, 6, and 7, the pump 100 further comprises an impeller 14. The impeller 14 is arranged to rotate inside the housing 30 around a first axis A1 of the pump 100 (shown in FIG. 6). The pump 100 comprises a shaft 21 for the impeller 14. The shaft 21 for the impeller 14 may be arranged in the first end section 24 of the housing 30. The impeller 14 may be arranged in the mid-section 16 of the housing 30. A motor (not shown) may be connected to the shaft 21 for rotating the impeller 14.

The impeller 14 is preferably fixedly arranged in the housing 30, as seen in the longitudinal direction H. This means that there is no movement of the impeller 14 relative the housing 30, as seen in the longitudinal direction H, once the impeller is mounted as intended for performing a pumping operation.

The impeller 14 has a base surface 141 and a number of impeller teeth 143 which extend from the base surface 141 in the longitudinal direction H. The impeller 14 has a top surface 142 that is located on the top of the impeller teeth 143. The impeller 14 may have an annular protrusion 14*a*. The annular protrusion 14*a* may be arranged on the other end of the impeller 14, opposite to the end where the impeller teeth 143 are arranged. The shaft 21 for the impeller 14 may also comprise an annular protrusion 21*a*. The annular protrusion 21*a* of the shaft 21 may abut the annular protrusion 14*a* on the impeller 14. The pump 100 further comprises a clamp arrangement 17. The clamp arrangement 17 may comprise two semi-annular parts 17*a*, 17*b*. The two semi-annular parts 17*a*, 17*b* of the clamp arrangement 17 may be configured to be connected to each other around the protrusions 21*a*, 14*a* for fixing the shaft 21 to the impeller 14 in the longitudinal direction H.

With further reference to FIGS. 5*a* and 5*b*, the pump 100 comprises a star wheel 12. The star wheel 12 is arranged to be driven by the impeller 14 to rotate around a second axis A2 of the pump 100. The second axis A2 of the pump 100 is offset from the first axis A1, see FIG. 6. The star wheel 12 may have the principal shape of a gear with a center opening 122 and a plurality of star wheel teeth 123. The star wheel 12 have a front surface 121. The star wheel 12 may be positioned within the impeller teeth 1143, so that some of the star wheel teeth 123 may extend into the spaces that are formed between the impeller teeth 143. When the impeller 14 is driven to rotate around the first axis A1, then the impeller teeth 143 may engage with the star wheel teeth 123 so that the star wheel 12 may rotate around the second axis A2 in a rotational direction, pumping of the liquid food product F from the inlet 40 to the outlet 50.

The pump 100 further comprises a base unit 10 on which the star wheel 12 is arranged. The star wheel 12 may be arranged on the base unit 10 via an axle 11 that is connected to the base unit 10. The star wheel 12 is arranged on this axle 11. The base unit 10 is movable in a longitudinal direction H parallel to the first axis A1, from a closed position P1, to an open position P2. The closed position P1 may be a position where a major portion of the star wheel 12 is located between the impeller teeth 143. A major portion of the star wheel 12 may comprise more than 50% of the star wheel 12 seen in the longitudinal direction H. The open position P2 may be a position where a minor portion of the star wheel 12 is located between the impeller teeth 143. A minor portion of the star wheel 12 may comprise less than 50% of the star wheel 12 seen in the longitudinal direction H.

FIGS. 5*a* and 5*b* show that the base unit 10 has a base surface 102 and a back surface 103. The back surface 103 of the base unit 10 is arranged on a side opposite to the side where the base surface 102 is arranged. The pump 100 may further comprise at least one rod section 9 for moving the base unit 10. The at least one rod section 9 may be connected to the back surface 103 of the base unit 10. The at least one rod section 9 for moving the base unit 10 may be located in the second end section 7 of the housing 30.

The base unit 10 comprises an arc-shaped element 105 that extends in between a respective section of the star wheel 12 and the impeller 14, such that the product F is pumped from the inlet 40 to the outlet 50 when the base unit 10 is in the closed position P1 and the impeller 14 rotates and drives the star wheel 12. The arc-shaped element 105 may extend from the base unit 10 into a position between the impeller 14 and the star wheel 12. The arc-shaped element 105 may also be referred to as a protrusion since it protrudes from the base unit 10, into the position between the impeller 14 and the star wheel 12. FIG. 5*a* shows that the arc-shaped element 105 extends along a part of a periphery of the star wheel 12. The arc-shaped element 105 is arranged at a side of the star wheel 12 that is opposite where the impeller teeth 143 may engage with the star wheel teeth. The arc-shaped element 105 has a top surface 101. The arc-shaped element 105 may have a similar length as the thickness of the star wheel 12, as seen in the longitudinal direction H. The impeller teeth 143 may also have a similar height as the arc-shaped element, as seen in the longitudinal direction H. The star wheel 12 is arranged on the axle 11 that extends from the base unit 10. The axle 11 may be centered around the second axis A2 and may be attached to the base unit 10 by using any suitable, conventional technique, or may be made as an integral part of the base unit 40.

With further reference to FIGS. 8 and 9, the pump 100 comprises an adjustment device 60. The adjustment device 60 is configured to adjustably set a position of the base unit 10 in the longitudinal direction H to thereby, when the base unit 10 is in the closed position P1, provide in the longitudinal direction H an adjusted distance D of at most 2.0 mm, at most 1.0 mm, at most 0.5 mm or at most 0.2 mm between the impeller 14 and the star wheel 12 and/or between the impeller 14 and the base unit 10.

The adjustment device 60 may comprise a rod 5 connected to the base unit 10, either directly or via the rod section 9, or with another suitable connection element that joins the rod 5 and the base unit 10. The rod 5 may have an outer part 5*a* that extends through an opening 4*a* in the housing 30. The adjustment device 60 may have a stationary element 4 that has a fix position relative the housing 30. The stationary element 4 may be a part 4 of the housing 30. The stationary element 4 may be configured to be attached/connected to the housing 30, such as to the second end section 7 of the housing 30. The adjustment device 60 may further have an adjustable element 2 in engagement with the outer part 5*a* of the rod 5 and arranged to interact with the stationary element 4 for providing the adjusted distance D. The adjustable element 2 may be movable in the longitudinal direction H relative to the stationary element 4 and/or the rod 5 for providing the adjusted distance D. A piston 6 is connected to the rod 5. A first chamber 62 is formed, as seen in FIG. 6, on the left hand of the piston 6, between the piston 6 and a partition wall 61 in the housing 30. By feeding pressurized air into the first chamber 62, the base unit 10 can be moved to the open position P2 illustrated in FIG. 7. A second chamber 63 is formed between the partition wall 61 and the backside of the base unit 10. A third chamber 64 is formed between the piston 6 and an end portion 65 of the housing 30. By feeding pressurized air into one or both of the second and third chambers 63, 64, the base unit 10 can be moved from the open position P2 to the closed position illustrated in FIG. 6. The base unit 10 is switchable from the closed position P1 to the open position P2 by controlling a pressure fed to one of both of the first chamber 62 and the second chamber 63.

The pump 100 has several parts, including e.g. a pump house bushing 15, a V-ring 18, a bracket cover 19, a radial shaft seal 20, a bracket safety cover 22, a ball bearing 23, a plug 26 and a coupling 27. The coupling is used for connecting a motor to the pump 100, such that the motor can rotate the impeller 14.

FIGS. 8 and 9 show on embodiment of an adjustment device 60 which has an adjustable element 2 that is covered by a cover 1. The cover 1 may have the form of a sleeve and may lock the adjustable element 2 so that it cannot rotate. The adjustable element 2 may be a nut 2, e.g. a threaded nut 2. The outer part 5*a* of the rod 5 may be provided with threads for engagement with the nut 2. A spacer 3 is located between the stationary element 4, which here is an end section of the housing, and the adjustable element 2 for providing the adjusted distance D. The stationary element 4 may comprise a protrusion 403 around which the spacer 3 is at least partially arranged. The spacer 3 extends, as seen in the longitudinal direction H and in relation to the protrusion 403, further towards the adjustable element 2 by a distance that corresponds to the adjusted distance D. The stationary element 4 has a first surface 401 and a second surface 402. The second surface 402 may be arranged opposite to the first surface. The first surface 401 of the stationary element 4 may face the adjustable element 2. The stationary element 4 may have the protrusion 403 on the first surface 401. The spacer 3 is arranged at least partially around the protrusion 403. An extension D1 of the protrusion 403 in the longitudinal direction H may be about 2.0 mm. A thickness D2 of the spacer 3 in the longitudinal direction H may same as the extension D1 of the protrusion 403, plus the desired adjusted distance D. The adjusted distance D can therefore be calculated as D=D2−D1. As indicated, the pump 100 may be in a closed position P1 and an open position P2. The adjusted distance D is the distance between the impeller 14 and the star wheel 12 and/or between the impeller 14 and the base unit 10, as seen in the longitudinal direction H. The adjusted distance D may correspond to a distance between the base surface 141 of the impeller and the front surface 121 of the star wheel 12. Alternatively or in combination, the adjusted distance D may correspond to a distance between the base surface 141 of the impeller 14 and the top surface 101 of the arc-shaped element 105. Alternatively or in combination, the adjusted distance D may correspond to a distance between the top surface 142 of the impeller 14 and the base surface 102 of the base unit 10.

The adjustable element 2 may be movable, in sequential order and in the longitudinal direction H. The adjustable element 2 may be movable to a first position out of contact with the stationary element 4. For instance, a technician may set the pump 100 in the open position P2 and move the adjustable element 2 e.g. unscrew the nut 2 such that it is moved further away from the stationary element 4. The technician may thereafter set the pump 100 in the closed position P1, such that the impeller 14 and the star wheel 12 and/or the impeller 14 and the base unit 10 are in contact with each other. Since the nut 2 was screwed out, it is now not in contact with the stationary element 4 (the protrusion 403).

The adjustable element 2 may then be moved a second position in contact with the stationary element 4 (the protrusion 403). For instance, the technician may move the adjustable element 2 e.g. screw the nut 2 such that it becomes in contact with the stationary element 4, or in contact with the protrusion 403.

The adjustable element 2 is movable to a third position that is offset from the second position by a distance corresponding to the adjusted distance D, as seen in the longitudinal direction H. This may be done by setting the pump 100 in the open position P2 and arrange the spacer 3 around the protrusion 403 as described above. Thereafter the pump 100 set in the closed position P1 such that it is ready to operate. The predefined adjusted distance D has then, by virtue of the spacer 3, been provided between the impeller 14 and the star wheel 12 and/or between the impeller 14 and the base unit 10. This is because the spacer "moves" the nut outwards, and thereby also moves the rod and the base unit away from the impeller.

FIG. 10*a-f* show various embodiments of an adjustment device 60 that can be used for the pump 100.

FIG. 10*a* shows that the adjustable element 2 is a nut 2. The nut 2 may be internally threaded. The outer part 5*a* of the rod 5 is provided with threads for engagement with the nut 2. A sleeve 1 may be used for fixing the nut 2 on the outer part 5*a* of the rod 5. For this purpose, the sleeve 1 may have an internal shape that corresponds to the external shape of the nut 2. The sleeve 1 may be fixed to the housing 30 in any suitable manner. The adjustment device 60 is operated by unscrewing the nut 2 when the pump 100 is in the closed position P1, until the nut 2 does not contact the stationary element 4. The impeller 14 and the star wheel 12 and/or the impeller 14 and the base unit 10 are then in contact. Next the nut 2 is tightened such that it comes into contact with the stationary element 4. Thereafter the nut 2 is further tightened to thereby pull out the rod 5. The pitch of the threads and the angle by with which the nut 2 is rotated determines how much the rod 5 is pulled out, i.e. which adjusted distance D is set. For example, if the thread pitch for the nut 2 is 1.0 mm and the thread is rotated by 120°, then an adjusted distance D of about 0.33 mm is set. The sleeve 1 may be omitted. The nut 2 may be a self-locking nut of a conventional type.

FIG. 10*b* shows an adjustment device 60 that corresponds to the adjustment device of FIG. 10*a*, with the difference that the sleeve is replaced with a locking nut 2*b*. When the nut 2 has been operated to set the adjusted distance D, then the locking nut 2*b* is tightened against the nut 2 for securing it, thereby preventing that the nut 2 is unintentionally rotated.

FIG. 10*c* shows an adjustment device 60 that corresponds to the adjustment device of FIG. 10*a*, with the difference that the nut is replaced with a clamp 2*c*, the outer part 5*a* of the rod 5 is provided with a friction increasing surface that interacts with the clamp 2*c*, and the sleeve is omitted. The adjusted distance D is set by, when the pump is in the closed position P1, manually pulling out the rod 5 by a distance that corresponds to the adjusted distance D, and thereafter securing the clamp 2*c* on the rod 5 with the clamp 2*a* in contact with the stationary element 4.

FIG. 10*d* shows an adjustment device 60 that has a sleeve shaped stationary element 4' which is connected to the housing 30 and surrounds the outer part 5*a* of the rod 5. The sleeve shaped stationary element 4' has internal threads. An externally threaded disk 2*d* engages the threads in the stationary sleeve 4', and can be screwed further into respectively out from the stationary sleeve 4' in the longitudinal direction H. The outer part 5*a* of the rod 5 has a protrusion 5*b*. The threaded disk 2*d* is located between the opening 4*a* in the housing 30 and the protrusion 5*b*. The adjustment device is operated by unscrewing the threaded disk 2*d* when the pump 100 is in the closed position P1, until the disk 2*d* does not contact the protrusion 5*b* on the rod 5. The impeller 14 and the star wheel 12 and/or the impeller 14 and the base unit 10 are then in contact. Next the disk 2*d* is tightened such that it comes into contact with the protrusion 5*b* (by being screwed to the right in the figure). Thereafter the disk 2*d* is further tightened to thereby pull out the rod 5. The pitch of the threads on the disk 2*d* and the angle by with which the disk 2*d* is rotated determines how much the rod 5 is pulled out, i.e. which adjusted distance D is set.

FIG. 10*e* shows an adjustment device 60 which is, except for the sleeve, a combination of the adjustment devices of FIGS. 10*a* and 10*d*. The adjusted distance *D* may then be set by screwing one of or both the nut 2 and the disk 2*d*.

FIG. 10*f* shows an adjustment device 60 that corresponds to the adjustment devices of FIG. 10*a* except for the sleeve. The adjustment device 60 has a motor 70. The motor 70 is arranged to rotate and thereafter fix the adjustable element 2 in relation to the rod 5. FIG. 10*f* shows that the nut is connected to the motor 70. The motor 70 may be equipped with e.g. a torque sensor to sense a torque when the nut 2 is screwed to abut the stationary element 4. Thereafter the nut 2 is further tightened by the motor to thereby pull out the rod 5. This is accomplished by controlling the motor 70 to rotate the nut 2 by the rotational angle that results in the adjusted distance D, in a manner similar to the adjustment procedure described in connection with FIG. 1. The motor 70 is thereafter controlled so as to not move the nut 2, which thereby fixes the nut relative the rod 3.

The different embodiments shown in FIGS. 10*a* to 10*f* may be combined as appropriate.

FIG. 11 shows a schematic illustration of steps of a method 200 for adjusting a pump 100. The pump 100 may correspond to the pump 100 described above. The method 200 comprises, in the longitudinal direction H, moving 210 the adjustable element 2 to a first position out of contact with the stationary element 4, when the impeller 14 and the star wheel 12 and/or the impeller 14 and the base unit 10 are in contact with each other. The method 200 further comprises moving 220 the adjustable element 2 to a second position in contact with the stationary element 4. The method 200 further comprises moving 240 the adjustable element 2 to a third position that is offset from the second position by a distance corresponding to the adjusted distance D, as seen in the longitudinal direction H relative the stationary element and/or the rod 5. The method 200 may further comprise, after the moving 230 of the adjustable element 2 to the second position and before the moving 240 of the adjustable element 2 to the third position, locating 230 a spacer 3 between the stationary element 4 and the adjustable element 2 for providing the adjusted distance D. This method is performed for the adjustment device shown in FIGS. 8 and 9. When the pump 100 has an adjustment device as shown in any for FIGS. 10*a* to 10*f*, the adjusted distance D is set as described for the respective adjustment device.

From the description above follows that, although various embodiments of the invention have been described and shown, the invention is not restricted thereto, but may also be embodied in other ways within the scope of the subject-matter defined in the following claims.

The invention claimed is:

1. A pump for pumping a liquid food product, the pump comprising:

a housing having an inlet and an outlet for the product, an impeller arranged to rotate inside the housing around a first axis of the pump, a star wheel arranged to be driven by the impeller to rotate around a second axis of the pump that is offset from the first axis, a base unit arranged to support the star wheel, the base unit being movable in a longitudinal direction parallel to the first axis, from a closed position, to an open position, the base unit comprising an arc-shaped element that extends in between the star wheel and the impeller, such that the product is pumped from the inlet to the outlet when the base unit is in the closed position and the impeller rotates and drives the star wheel, wherein an adjustment device configured to adjustably set a position of the base unit in the longitudinal direction to thereby, when the base unit is in the closed position, provide in the longitudinal direction a predefined adjusted distance between the impeller and the star wheel and/or between the impeller and the base unit, wherein the adjustment device comprises:

a rod connected to the base unit and having an outer part that extends through an opening in the housing, a stationary element that has a fix position relative the housing, and an adjustable element in engagement with the outer part of the rod and arranged to interact with the stationary element for providing the adjusted distance, and wherein the adjustable element is movable, in sequential order and in the longitudinal direction, to:

a first position out of contact with the stationary element, when the impeller and the star wheel and/or the impeller and the base unit are in contact with each other, a second position in contact with the stationary element, and a third position that is offset from the second position by a distance corresponding to the adjusted distance, as seen in the longitudinal direction relative to the stationary element and/or the rod.

2. The pump according to claim 1, wherein the adjustable element is movable in the longitudinal direction relative to the stationary element and/or relative to the rod for providing the adjusted distance.

3. The pump according to claim 1, wherein the stationary element is a part of the housing.

4. The pump according to claim 1, wherein the adjustable element is a threaded nut and the outer part of the rod is provided with threads for engagement with the nut.

5. The pump according to claim 4, wherein the adjustment device comprises a nut locking element for fixing the nut on the outer part of the rod.

6. The pump according to claim 1, wherein the adjustment device comprises a motor arranged to set and fix the adjustable element in relation to at least one of the stationary element and the rod.

7. The pump according to claim 1, wherein the adjustment device comprises a spacer that is located between the stationary element and the adjustable element for providing the adjusted distance.

8. The pump according to claim 7, wherein the housing comprises a protrusion around which the spacer is at least partially arranged, wherein the spacer extends, as seen in the longitudinal direction and in relation to the protrusion, further towards the adjustable element by a distance that corresponds to the adjusted distance.

9. The pump according to claim 1, wherein the housing comprises a first end section in which a shaft for the impeller is arranged, a mid-section in which the impeller is arranged, and a second end section in which at least one piston for moving the base unit is arranged, wherein the first end section of the housing has elongated through holes that extend in the longitudinal direction for receiving first bolts that connect the first end section to the mid-section, and the second end section of the housing has elongated through holes that extend in the longitudinal direction for receiving second bolts that connect the second end section to the mid-section.

10. The pump according to claim 9, wherein the shaft for the impeller comprises an annular protrusion that abuts a corresponding annular protrusion on the impeller, wherein the pump further comprises a clamp arrangement that comprises two semi-annular parts configured to be connected to each other around the protrusions for fixing the shaft to the impeller in the longitudinal direction.

11. A method of adjusting a pump according to claim 1, the method comprising, in the longitudinal direction, moving the adjustable element to a first position out of contact with the stationary element, when the impeller and the star wheel and/or the impeller and the base unit are in contact with each other, moving the adjustable element to a second position in contact with the stationary element, and moving the adjustable element to a third position that is offset from the second position by a distance corresponding to the adjusted distance, as seen in the longitudinal direction relative the stationary element and/or the rod.

12. The method according to claim 11, further comprising, after the moving of the adjustable element to the second position and before the moving of the adjustable element to the third position, locating a spacer between the stationary element and the adjustable element for providing the adjusted distance.

13. A pump for pumping a liquid food product, the pump comprising:

a housing having an inlet and an outlet for the product, an impeller arranged to rotate inside the housing around a first axis of the pump, a star wheel arranged to be driven by the impeller to rotate around a second axis of the pump that is offset from the first axis, a base unit arranged to support the star wheel, the base unit being movable in a longitudinal direction parallel to the first axis, from a closed position, to an open position, the base unit comprising an arc-shaped element that extends in between the star wheel and the impeller, such that the product is pumped from the inlet to the outlet when the base unit is in the closed position and the impeller rotates and drives the star wheel, wherein an adjustment device configured to adjustably set a position of the base unit in the longitudinal direction to thereby, when the base unit is in the closed position, provide in the longitudinal direction a predefined adjusted distance between the impeller and the star wheel and/or between the impeller and the base unit, wherein the adjustment device comprises:

a rod connected to the base unit and having an outer part that extends through an opening in the housing, a stationary element that has a fix position relative the housing, and an adjustable element in engagement with the outer part of the rod and arranged to interact with the stationary element for providing the adjusted distance, and wherein the adjustable element is movable, in sequential order and in the longitudinal direction, to:

a first position out of contact with the rod, when the impeller and the star wheel and/or the impeller and the base unit are in contact with each other, a second position in contact with the rod, and a third position that is offset from the second position by a distance corresponding to the adjusted distance, as seen in the longitudinal direction relative to the stationary element and/or the rod.

* * * * *